US006379770B2

(12) United States Patent
Vair, Jr. et al.

(10) Patent No.: US 6,379,770 B2
(45) Date of Patent: Apr. 30, 2002

(54) MELTBLOWN FIBROUS SORBENT MEDIA

(75) Inventors: Larry Leroy Vair, Jr., Lakewood, CO (US); Robert G. Sanders; Cleotha Jennings, both of Jackson, MS (US); James Edward Jones, III, Madison, MS (US)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/801,355

(22) Filed: Mar. 7, 2001

Related U.S. Application Data

(60) Division of application No. 09/337,302, filed on Jun. 21, 1999, now Pat. No. 6,270,608, which is a continuation-in-part of application No. 09/220,730, filed on Dec. 24, 1998, now Pat. No. 6,217,691.

(51) Int. Cl.[7] ..... B32B 27/32; B32B 5/32

(52) U.S. Cl. ..... 428/74; 428/137; 428/76; 442/350; 442/400; 442/409; 604/383; 604/366; 604/370

(58) Field of Search ..... 428/74, 76, 131, 428/137; 442/350, 409, 400; 604/383, 366, 370

(56) References Cited

U.S. PATENT DOCUMENTS 3,855,045 A * 12/1974 Brock ..... 161/146
5,667,864 A * 9/1997 Landoll ..... 428/74
5,865,824 A * 2/1999 Chen et al. ..... 604/378

* cited by examiner

*Primary Examiner*—Sam Chuan Yao
(74) *Attorney, Agent, or Firm*—Robert D. Touslee

(57) ABSTRACT

Fibrous sorbent media or pads are formed from non-woven mats of thermoplastic fibers, preferably polypropylene fibers, having a mean diameter between about 0.5 microns and about 25 microns. The mats have a weight between about 2 ounces/yd$^2$ and about 25 ounces/yd$^2$; a thickness of at least 1/20 of an inch; an oil absorbency ratio of at least 5 to 1 or a water absorbency ratio of at least 5 to 1. The sorbent media have first and second major surfaces with abrasion resistant, liquid permeable, integral skins and fibrous cores. The liquid permeable skins of the media are formed by melting fibers at and immediately adjacent the major surfaces of the mats to form thermoplastic melt layers which are subsequently solidified into the skins on the major surfaces of the mats. For many applications, the thermoplastic fibers of the mats are point bonded together at spaced apart locations to increase the integrity of the mats.

10 Claims, 2 Drawing Sheets

MELTBLOWN FIBROUS SORBENT MEDIA

This application is a division of application Ser. No. 09/337,302, filed Jun. 21, 1999 now U.S. Pat. No. 6,270,608.

This application is a continuation-in-part application of patent application Ser. No. 09/220,730, filed Dec. 24, 1998 now U.S. Pat. No. 6,217,691

BACKGROUND OF THE INVENTION

The present invention relates to "throw away" meltblown fibrous sorbent media of thermoplastic fibers and, in particular, to meltblown fibrous sorbent media of thermoplastic fibers which are especially suited for absorbing oil or water and other liquids and the method of making such sorbent media.

Fibrous sorbent media made of thermoplastic fibers are used for many clean up applications including but not limited to: cleaning up oil spills on water; cleaning machinery, engines and other equipment; cleaning up oil, water, grease or other liquids from floors and other surfaces; etc. Typically, these fibrous sorbent media are intended to be properly discarded after only one use or only a few uses.

Fibrous polypropylene sorbent media is particularly well suited for such tasks. For example, fibrous polypropylene sobrbent media has an affinity for oil and is hydrophobic. Thus, fibrous polypropylene sorbent media will soak up or absorb oil without absorbing water and can be used effectively to clean up oil spills on water. When the fibers of fibrous polypropylene sorbent media are treated or coated with a surfactant, the media will absorb water and other similar liquids. Thus, when treated with a surfactant, fibrous polypropylene sorbent media can be used to clean up water and other liquids in addition to oil.

Previously, the process for producing the fibrous sorbent media manufactured and sold by Johns Manville International, Inc., has essentially included three processes. In the first process, a thin meltblown tightly bonded cover stock is formed having a basis weight of about 0.75 oz/yd$^2$ or another cover stock, such as but not limited to a spun bond cover stock is formed. In the second process an air-laid, non-woven mat or fibrous layer of loose lofty randomly oriented meltblown thermoplastic fibers, e.g. polypropylene fibers having a mean diameter of about 15 microns, and of the required thickness is formed. In a third process a heated pin or calendar roll collates a layer of cover stock onto each major surface of the mat or fibrous layer and, through the heated pins of a pin or calendar roll, heat point bonds the layers of cover stock to the major surfaces of the mat. The resulting product is a fibrous sorbent media laminate with a fibrous core layer of loose lofty fibers encapsulated between two surface layers of cover stock that are heat point bonded to the fibrous core layer. The loose fibers within the media provide an effective surface area for good liquid absorption and the layers of cover stock provide the laminate with the required tensile strengths and abrasion resistance. The heat point bonding of the layers of cover stock to the fibrous core layer provides the fibrous sorbent media with added integrity and improves the "handle-ability" of the product. Fibrous thermoplastic sorbent media laminates, such as the sorbent media just described, provide good liquid absorption for many applications. However, since these sorbent media are primarily used for applications where the sorbent media is discarded after only one use or only a few uses, there has remained a need for fibrous thermoplastic sorbent media, with equal or better liquid absorption and abrasion resistance properties, that can be more economically produced.

SUMMARY OF THE INVENTION

The fibrous sorbent media of the present invention and the method of making the fibrous sorbent media of the present invention provide fibrous sorbent media that have liquid absorption and abrasion resistance properties which are equal to or greater than the fibrous sorbent media laminates of Johns Manville International Inc. discussed above and media which can be produced more economically (e.g. cost savings of up to 30% to 40%) than the fibrous sorbent media laminates of Johns Manville International Inc. discussed above. The sorbent media of the present invention is made of thermoplastic fibers having a mean diameter between about 0.5 microns and about 25 microns; has a weight between about 2 oz/yd$^2$ and about 25 oz/yd$^2$; a thickness typically between about 1/20 of an inch and about ½ of an inch; a lofty fibrous core; and first and second major surfaces with thin, relatively tough, tear and abrasion resistant, integral skins thereon. The skins are liquid permeable and permit liquids, such as but not limited to oil and water, to pass easily through the skins for absorption in the fibrous core of the sorbent media. The abrasion resistant skins add to the tensile strength of the sorbent media; help to keep the sorbent media from tearing apart in use; and prevent or greatly reduce the loss of fibers from the sorbent media in use, especially when the sorbent media is used for wiping machinery, floors, etc.

The abrasion resistant integral skins of the mat are formed by melting fibers at and immediately adjacent the major surfaces of the non-woven mat to form thermoplastic melt layers which are subsequently solidified into the abrasion resistant skins on the major surfaces of the mat. For many applications, the thermoplastic fibers of the mat are point bonded together at spaced apart locations to increase the integrity of the mat and, preferably, increase the thickness or loft of the mat adjacent the point bonded locations.

The method of forming the sorbent media of the present invention, e.g. on an on-line process, includes: air laying thermoplastic fibers having a mean fiber diameter between about 0.5 microns and about 25 microns to form a non-woven mat; melting the thermoplastic fibers at and immediately adjacent the major surfaces of the mat to form thermoplastic melt layers on the major surfaces of the mat; subsequently cooling the thermoplastic melt layers to form thin, integral thermoplastic, liquid permeable skins on the major surfaces of the mat; and, normally, point bonding the thermoplastic fibers of the mat together at spaced apart locations to increase the integrity of the mat and preferably, increase the loft of the mat adjacent the point bonds by displacement of some of the thermoplastic fibers from the locations of the point bonds.

The thermoplastic fibers at and immediately adjacent the major surfaces of the mat can be melted to form a thermoplastic melt layer on the major surfaces of the mat by flame treating, infrared treating or corona treating the surfaces of the mat. However, preferably, the thin, integral skins are formed on the major surfaces of the mat by passing the mat between a pair of heated nip or calendar rolls with smooth surfaces. Preferably, the major surfaces of the mat on which skins are being formed are pressed against the heated surfaces of the nip or calendar rolls by compressing the mat between the pair of heated nip or calendar rolls. It is believed that the compression of the mat brings more fibers into contact with the heated surfaces of the nip or calendar rolls and increases the density of the mat at and adjacent the heated surfaces of the nip or calendar rolls for better heat transfer from the nip or calendar rolls into the thermoplastic fibers of the mat. The result is a better melting of the thermoplastic fibers at and immediately adjacent the major surfaces of the mat to form melt layers on the major surfaces of the mat that are subsequently cooled and solidified to form the relatively tough, tear and abrasion resistant, liquid permeable, integral skins. When skins were formed on major surfaces of a mat without compressing the mat between heated nip or calendar rolls, the quality of the skin formed was considerably inferior to the skins formed by compressing the mat between heated nip or calendar rolls.

The compression of the mat between a pair of heated nip or calendar rolls, decreases the thickness of the mat. Accordingly, the thickness and resiliency of the non-woven mat being introduced into the skin forming station of the process line must be sufficient to accommodate the decrease in thickness caused by the skin forming operation without permanently decreasing the thickness and absorbent properties of the mat below acceptable levels.

Preferably, the point bonds are formed using the heat generated solely from the pressure exerted on the fibers by the pins of an unheated pin or calendar roll assembly. While the point bonds can be formed using heated pins of a heated pin or calendar roll assembly, the heat from the heated pins of such an assembly causes the thermoplastic fibers contacted and adjacent the heated pins to shrink down to form a point bond. When using unheated pins to form the point bonds, at least some of the thermoplastic fibers present along the paths of pins through the mat are pushed away or displaced from the paths of the pins thickening the mat adjacent the point bonds and leaving only a thin layer of thermoplastic fibers to form the point bonds through the heat generated by the pressure applied by the pins to the remaining thin layer of thermoplastic fibers. Thus, rather than decreasing the thickness of the mat which would decrease the absorption properties of the mat, the use of unheated pins maintains or in effect increases the thickness of the mat while increasing the integrity of the mat through the point bonding of thermoplastic fibers within the mat.

DESCRIPTION OF THE PREFERRED EMBODIMENTS

Figure 1:
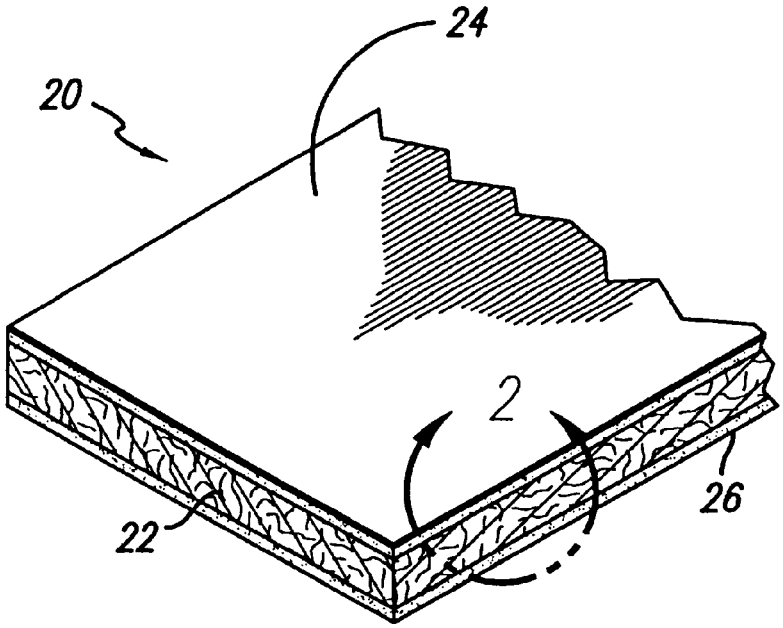
FIG. 1 is a schematic perspective view of a fibrous sorbent media or pad of the present invention with-thin, liquid permeable integral skins on both major surfaces.
Figure 2:
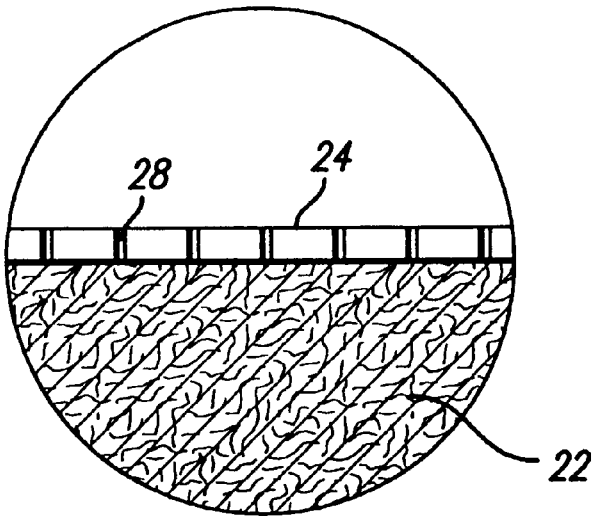
FIG. 2 is an enlarged schematic of the circled portion of the fibrous insulation medium of FIG. 1 to better illustrate the thin, liquid permeable integral skins formed on the major surfaces of the fibrous sorbent media of FIG. 1.

As shown in FIGS. 1 and 2, the non-woven fibrous sorbent media of the present invention 20 includes a lofty, fibrous layer 22 of randomly oriented, preferably air laid, thermoplastic fibers and two thin integral, liquid permeable skins 24 and 26 formed on both major surfaces of the sorbent media. The skins 24 and 26 increase the tensile strength of the sorbent media; help keep the sorbent media from tearing during handling and use; and envelope the fibrous layer 22 of the sorbent media to help maintain loose fibers within the sorbent media during handling and use.

The sorbent media 20, preferably, has a minimum oil and water absorbency ratio of 5 to 1 (the sorbent media 20 will absorb at least five times its weight in oil or water); more preferably, a minimum oil and water absorbency ratio of 7.5 to 1 (the sorbent media will absorb at least seven and one half times its weight in oil or water); and most preferably, a minimum oil and water absorbency ratio of 10 to 1 (the sorbent media will absorb at least ten times its weight in oil or water). The absorbency ratio for the sorbent media 20 is determined by weighing the dry weight of a test sample; saturating the test sample with the liquid to be absorbed; permitting the test sample to hang for thirty seconds to allow excess liquid to drain from the test sample; and then, weighing the test sample again. The weight of the test sample after it has been saturated with the liquid and the liquid has been allowed to drain from the test sample for thirty seconds relative to the initial dry weight of the test s-ample sets the absorbency ratio for the sorbent media being tested.

Typically, the fibrous sorbent media 20 are between about 1/20 of an inch and about ½ of an inch in thickness and have basis weights ranging from about 2 to about 25 ounces per square yard (e.g. 1/20 of an inch in thickness and 2 ounces per square yard; ¼ of an inch in thickness and 15 ounces per square yard; and ½ of an inch in thickness and 25 ounces per square yard).

Preferably, the-sorbent media 20 have a tensile strength in the machine direction of at least 1.5 pounds per inch; more preferably, at least 2.0 pounds per inch; and most preferably, at least 3.0 pounds per inch. Preferably, the sorbent media 20 have a tensile strength in the cross machine direction of at least 1.5 pounds per inch; more preferably, at least 2.0 pounds per inch; and most preferably, at least 3.0 pounds per inch.

As schematically shown in FIG. 2, the thin, integral, liquid permeable, abrasion resistant skins 24 and 26 have a plurality of holes or openings 28 therein to permit liquids to readily pass through the skins and into the lofty fibrous layer 22 where the liquids are absorbed and retained by the lofty fibrous layer. The skins 24 and 26 and the fibrous layer 22, taken together, typically have an air permeability between about 12 and about 40 cubic feet per minute per square foot of skin surface area; and preferably, between about 12 and about 25 cubic feet per minute per square foot of skin surface area. With the abrasion resistance of the skins 24 and 26 and the overall tensile strength of the sorbent media 20, the sorbent media can be used as a wiping cloth to clean up oil, water or other liquid spills; clean off machinery and other equipment; etc.

The thermoplastic fibers forming the non-woven fibrous sorbent media 20 have a mean fiber diameter, as measured by the surface analysis test commonly used in the industry (the BET test), between 0.5 microns and 25 microns. The greater the surface area provided by-the loose randomly oriented thermoplastic fibers in the fibrous insulation media 20, the better the liquid absorption properties of the media 20. Thus, provided the media retains its loft, for a given basis weight, the finer the diameter of the thermoplastic fibers forming the fibrous insulation media 20 the better the liquid absorption properties of the media and preferably, the thermoplastic fibers of the fibrous insulation media 20 have a mean diameter between about 2 microns and about 20 microns; more preferably between about 2 and about 15 microns; and most preferably between about 2 and about 10 microns.

Preferably, the fibrous sorbent media 20 of the present invention is made from an air laid, non-woven mat 30 of meltblown randomly oriented thermoplastic fibers. While the fibers are randomly oriented, the fibers predominately lie generally in planes extending generally parallel to the major surfaces of the mat. Typically, the mat of meltblown thermoplastic fibers forming the fibrous insulation media is made by melting a polymeric material within a melter or die 32 and extruding the molten polymeric material through a plurality of orifices in the melter or die 32 to form continuous primary filaments. The continuous primary filaments exiting the orifices are introduced directly into a high velocity heated air stream which attenuates the filaments and forms discrete meltblown fibers from the continuous filaments. The meltblown fibers thus formed are cooled and collected on a moving air permeable conveyor 34 to form the non-woven mat 30 of randomly oriented polymeric fibers having a thickness greater than the thickness of the fibrous sorbent media 20 to be formed from the mat 30, e.g. about 30% greater, and typically having a basis weight ranging from about 2 ounces/square yard to about 25 ounces/square yard. During this fiberization process, the molten polymeric material forming the fibers is rapidly cooled from a temperature ranging from about 450° F. to about 500° F. to The ambient temperature of the collection zone, e.g. about 80° F. The meltblown fibers formed by this process typically have a mean diameter from about 0.5 to about 25 microns.

The preferred polymeric material used to form the meltblown fibers of the fibrous insulation media of the present invention is polypropylene. Since polypropylene is hydrophobic, sorbent media 20, made of polypropylene fibers, are an ideal sorbent media or pads for absorbing oil spills on water. By applying a surfactant coating to the polypropylene fibers, sorbent media or pads 20, made with such coated fibers can be used to absorb water and other liquids other than oil. Typically, the polypropylene fibers are coated with a surfactant by spraying the surfactant on the fibers intermediate the formation of the polypropylene fibers and the collection of the fibers to form the mat 30.

The polypropylene or other polymeric material used to form the polymeric fibers of the fibrous sorbent media of the present invention may include between about 0.2% and about 10% by weight of a nucleating agent and preferably, between about 1% and about 3% by weight of a nucleating agent to facilitate the formation of discrete fine diameter fibers which, when collected to form the mat 30, do not tend to meld together to form a less fibrous sheet-like material. The presence of the nucleating agent in the polymeric material forming the fibers used in the fibrous sorbent media of the present invention increases the rate of crystal initiation-throughout the polymeric material thereby solidifying the fibers formed by the fiberization process of the present invention significantly faster than fibers formed from the polymeric material without the nucleating agent. The more rapid solidification of the polymeric material forming the fibers in the method of the present invention, due to the presence of the nucleating agent, reduces the tendency of the fibers to lose their discrete nature and meld together when collected and facilitates the retention of the fibers discrete nature when collected to form a resilient mat with high loft. In addition, the presence of the nucleating agent in the composition forming the fibers has been found to enhance the heat sealing properties of a polypropylene media.

The preferred nucleating agent used in the polymeric material of the present invention is bis-benzylidene sorbitol. An example of a suitable, commercially available, bis-benylidene sorbitol is MILLAD 3988 bis-benylidene sorbitol from Milliken & Company of Spartanburg, S.C. Although the particle size of the following nucleating agents may be too great, especially when forming very fine diameter fibers, it is contemplated that the following additives might also be used as nucleating agents: sodium succinate; sodium glutarate; sodium caproate; sodium 4-methylvalerate; sodium p-tert-butylbenzoate; aluminum di-p-tert-butylbenzoate; potassium p-tert-butylbenzoate; sodium p-tert-butylphenoxyacetate; aluminum phenylacetate; sodium cinnamate; aluminum benzoate; sodium B-benzoate; potassium benzoate; aluminum tertbutylbenzoate; anthracene; sodium hexanecarboxylate; sodium heptanecarboxylate; sodium 1,2-cyclohexanedicarboxylate; sodium diphenylacetate; sodium 2,4,5-tricholorphenoxyacetate; sodium cis-4-cyclohexane 1,2-dicarboxylate; sodium 2,4-dimethoxybenzoate; 2-napthoic acid; napthalene-1,8-dicarbokylic acid; 2-napthyloxyacetic acid; and 2-napthylacetic acid.

Figure 3:
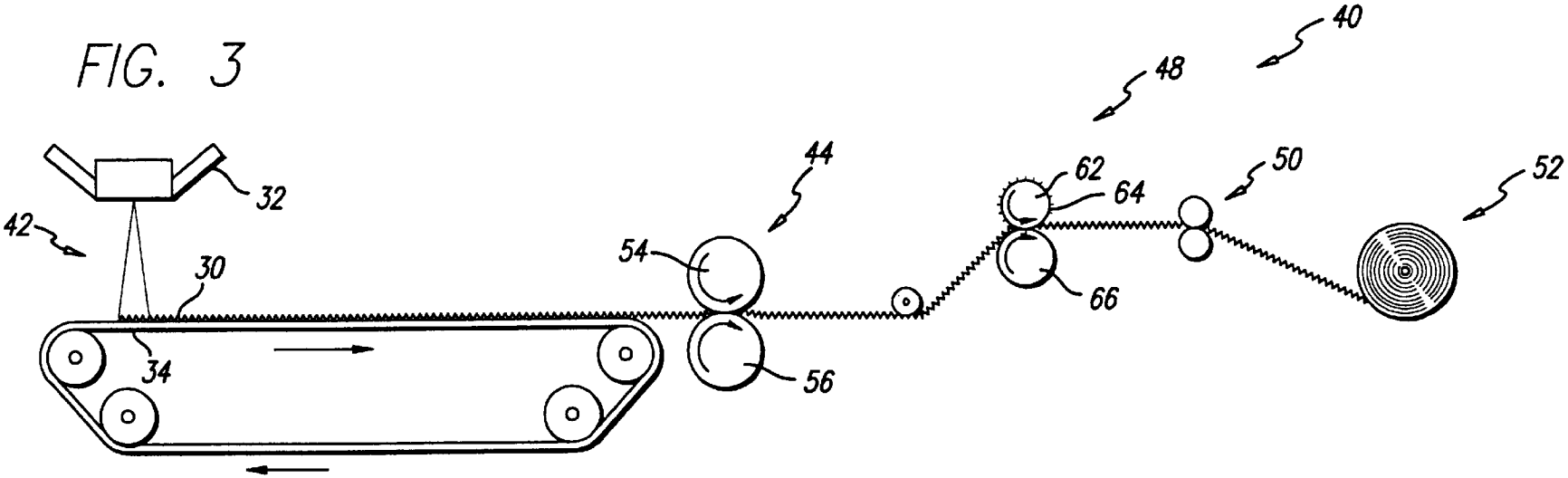
FIG. 3 is a schematic side elevation of a production line for making the fibrous sorbent media of FIG. 1.

As schematically shown in FIG. 3, a preferred production line 40 for making the fibrous sorbent media 20 of the present invention includes: a fiberization and collection station 42; a nip roll station 44; a point bonding station 48; a slitting station 50 and a windup station 52.

After the air laid non-woven mat 30 of meltblown thermoplastic fibers is collected in the fiberization and collection station 42, the mat 30 is conveyed to the nip roll station 44 where skins are formed on both major surfaces of the mat. In the nip roll station 44, the mat 30 is passed between upper and lower heated, smooth surfaced, cylindrical stainless steel nip rolls 54 and 56 (e.g. heated to a temperature between about 150° F. and about 350° F. and preferably, between about 220° F. and 240° F.). As the upper major surface of the mat 30 is brought into contact with the heated cylindrical surface of the nip roll 54, the thermoplastic fibers at and immediately adjacent the upper major surface of the mat 30 are melted by the heat from the nip roll to form a thin melt layer on the upper major surface of the mat 30. As the lower major surface of the mat 30 is brought into contact with the heated cylindrical surface of the nip roll 56, the thermoplastic fibers at and immediately adjacent the lower major surface of the mat 30 are melted by the heat from the nip roll to-form a thin melt layer on the lower major surface of the mat 30. When the upper and lower surfaces of the mat 30 move out of contact with the heated surfaces of nip roll 54 and 56, the thin melt layer on the upper and lower major surfaces of the mat 30 cool and solidify into liquid permeable the skins 24 and 26 that are integral with the fibrous core of the mat 30.

Preferably, the heated nip rolls 54 and 56 are spaced apart so that the mat 30 is compressed and subjected to pressure (e.g. a pressure between about 5 pounds per square inch and about 60 pounds per square inch) when passing between the heated nip rolls 54 and 56. The best results have been obtained by subjecting the mat 30 to compressive forces, as the mat passes between the heated nip roll 54 and 56, that compress the mat to between about 25% and about 50% of its final thickness. The compression of the mat 30 between the nip rolls 54 and 56 brings more of the mat's thermoplastic fibers into contact with the heated surfaces of the nip rolls 54 and 56 and increases the density of the mat 30 for better heat transfer to the fibers from the heated surfaces of the nip rolls 54 and 56. The result. is the formation of more coextensive and uniform thin melt layers on the upper and lower major surfaces of the mat 30 that are subsequently cooled to form the thin, liquid permeable, skins 24 and 26 on the upperland lower major surfaces of the mat 30 that are coextensive with the upper and lower major surfaces of the mat 30.

While it is preferred to use nip rolls 54 and 56 to form the two thin, liquid permeable, abrasion resistant integral skins 24 and 26 on the mat 30, the skins 24 and 26 can also be formed on the major surfaces of the mat 30 by flame treating, infrared treating or corona treating the surfaces of the mat.

After passing through the nip roll station 44 or a flame treating, infrared treating or corona treating station, for many applications, the mat 30 with its skinned surfaces passes through the point bonding station 48 to increase the mat's integrity. The point bonding station 48 includes a cylindrical stainless steel calendar roll 62 with a plurality of metal pins 64 projecting radially outward from the cylindrical surface of the calendar roll and a smooth surfaced cylindrical stainless steel backup roll 66. The pins 64 typically have a diameter of about 3/16 of an inch and a length sufficient to penetrate the mat 30 and place the thermoplastic fibers of the mat 30 under compression to effect a point bonding of the fibers at spaced apart locations in the mat 30. Preferably, the pressure applied to the thermoplastic fibers by the pins 64 is sufficient to generate sufficient heat to thermally bond the fibers together without the need to heat the calendar roll and its pins, e.g. a compressive pressure between about 50 and about 150 pounds per square inch.

As mentioned above, when the calendar roll 62 and its pins 64 are heated the thermoplastic material forming the fibers contacting and adjacent the pins tends to melt and shrink down. When the calendar roll 62 and its pins 64 are not heated, a large portion of the thermoplastic fibers of the mat in and immediately adjacent the paths of the pins are displaced from the bonding areas by the pins 64 as the pins pass through the mat 30 until only a thin layer of fibers remain to form the heat point bonds. The displaced and in many cases reoriented thermoplastic fibers (reoriented out of the planes of the major surfaces) effectively increase the loft and the thickness of the mat 30 adjacent the point bonds to improve the fibrous sorbent media's liquid absorption properties and provide the fibrous sorbent media formed with a "quilted" appearance.

Figure 4:
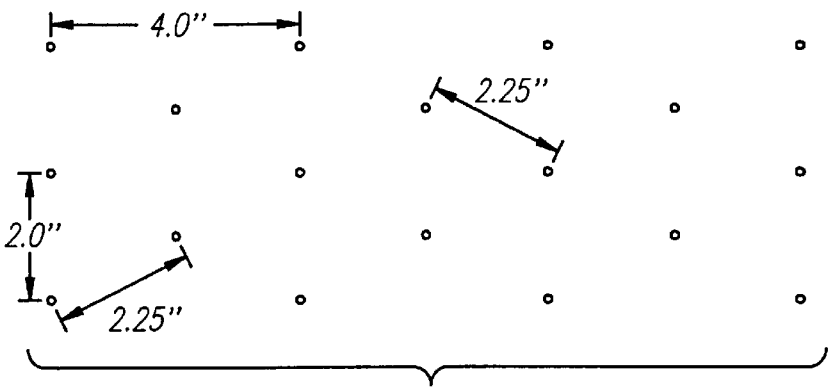
FIG. 4 is a schematic layout of a preferred pin pattern for the point bonding operation.

While other patterns can be used to locate the pins 64 and thus the point bonds in the mat 30, one preferred pin pattern is shown in FIG. 4. In this pattern, the pins 64 in each row are spaced from each other on about 4.0 inch centers; the rows are spaced from each other about 1.0 inch centers; and the pins 64 in successive rows are off set from each other so that the pins 64 are spaced apart from each other on centers of about 2.25 inches. When the pins 64 are spaced apart from each other on less than about 1.0 inch centers, the point bonding operation tends to squeeze the mat 30 and reduce the mat's thickness. When the pins 64 are spaced apart from each other on more than about 2.5 inch centers, no significant loft or added thickness to the mat 30 is created by the point bonding operation.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A fibrous sorbent media, comprising:

a non-woven mat of thermoplastic fibers, the thermoplastic fibers having a mean diameter between about 0.5 microns and about 25 microns; the mat having a weight between about 2 ounces/yd$^2$ and about 25 ounces/yd$^2$ and a thickness of at least 1/20 of an inch; the thermoplastic fibers being point bonded together at spaced apart locations to increase the integrity of the mat; the mat consisting essentially of a fibrous core with first and second major surfaces formed by liquid permeable integral skins that increase the tensile strength and abrasion resistance of the media; the integral skins being formed by melting fibers at and immediately adjacent the major surfaces of the mat to form thermoplastic melt layers which are subsequently solidified into the integral skins on the first and second major surfaces of the mat; the integral skins on the first and second major surfaces and the fibrous core, together, having an air permeability between about 12 and about 40 cubic feet per minute per square foot of major surface area; the mat having a minimum oil absorbency of 5 to 1; the mat having a tensile strength in the machine direction of at least 1.5 pounds/inch of mat width and at tensile strength in the cross machine direction of at least 1.5 pounds/inch of mat length.

2. The fibrous sorbent media according to claim 1, wherein:

the thermoplastic fibers are polypropylene fibers.

3. The fibrous sorbent media according to claim 1, wherein:

the thermoplastic fibers are polypropylene fibers; the fibers have a surfactant thereon; and the mat has a minimum water absorbency ratio of 5 to 1.

4. The fibrous sorbent media according to claim 1, wherein:

the thermoplastic fibers are polypropylene fibers having a mean diameter between about 2 microns and about 15 microns; the mat has a minimum oil and water absorbency ratio of 7.5 to 1; and a tensile strength in the machine direction of at least 2.0 pounds/inch of width and a tensile strength in the cross machine direction of at least 2.0 pounds/inch of length.

5. The fibrous sorbent media according to claim 4, wherein:

the integral skins on the first and second major surfaces and the fibrous core, together, having an air permeability between about 12 and about 25 cubic feet per minute per square foot of major surface area.

6. The fibrous sorbent media according to claim 5, wherein:

the mat is thickest adjacent the point bonds due to a displacement of the thermoplastic fibers when the mat is point bonded.

7. The fibrous sorbent media according to claim 1, wherein:

the thermoplastic fibers are polypropylene fibers having a mean diameter between about 2 microns and about 10 microns; the mat has a minimum oil and water absorbency ratio of 10 to 1; and a tensile strength in the machine direction of at least 3.0 pounds/inch of width and a tensile strength in the cross machine direction of at least 3.0 pounds/inch of length.

8. The fibrous sorbent media according to claim 7, wherein:

the integral skins on the first and second major surfaces and the fibrous core, together, having an air permeability between about 12 and about 25 cubic feet per minute per square foot of major surface area.

9. The fibrous sorbent media according to claim 8, wherein:

the mat is thickest adjacent the point bonds due to a displacement of the thermoplastic fibers when the mat is point bonded.

10. The fibrous sorbent media according to claim 1, wherein:

the mat is thickest adjacent the point bonds due to a displacement of the thermoplastic fibers when the mat is point bonded.

* * * * *